US011926450B1

(12) United States Patent
Williams

(10) Patent No.: US 11,926,450 B1
(45) Date of Patent: Mar. 12, 2024

(54) BAG WITH SURFACE ATTACHMENT DEVICES

(71) Applicant: Go CEO, LLC, Auburn, AL (US)

(72) Inventor: David Wesley Williams, Auburn, AL (US)

(73) Assignee: Go CEO, LLC, Auburn, AL (US)

( * ) Notice: Subject to any disclaimer, the term of this patent is extended or adjusted under 35 U.S.C. 154(b) by 16 days.

(21) Appl. No.: 17/747,363

(22) Filed: May 18, 2022

Related U.S. Application Data

(60) Provisional application No. 63/318,246, filed on Mar. 9, 2022.

(51) Int. Cl.
*B65D 33/14* (2006.01)
*B65D 33/25* (2006.01)

(52) U.S. Cl.
CPC ..... *B65D 33/14* (2013.01); *B65D 33/2508* (2013.01)

(58) Field of Classification Search
CPC ..... B65D 33/14; B65D 33/2508
USPC ..... 383/16
See application file for complete search history.

(56) References Cited

U.S. PATENT DOCUMENTS 4,531,246 A 7/1985 Earley
4,846,429 A 7/1989 Scheurer et al.
4,848,542 A * 7/1989 Burnette ..... G02B 7/182 428/912.2
5,092,682 A 3/1992 Fenick
5,636,925 A 6/1997 Smiley
5,741,076 A 4/1998 Cammack
6,131,865 A 10/2000 Adams
7,066,340 B2 6/2006 Robertson
7,458,925 B2 12/2008 Turvey
8,378,932 B2 3/2013 Takahashi et al.
8,387,783 B2 * 3/2013 Zack ..... A47K 3/001 206/77.1
9,295,314 B2 3/2016 McClees
10,150,592 B2 * 12/2018 Hartley ..... B65D 23/003
10,712,070 B1 7/2020 Touchton
2003/0006243 A1 1/2003 Looney
2005/0254731 A1 11/2005 Berbert et al.
2006/0282936 A1 * 12/2006 Olson ..... A41D 19/01558 2/161.7
2007/0053616 A1 3/2007 Plouff
2009/0257690 A1 10/2009 Spenceley et al.
2010/0003887 A1 1/2010 Greene
2010/0135602 A1 6/2010 Turvey et al.
2010/0329592 A1 12/2010 Hefner
2011/0019937 A1 1/2011 Steinwagner et al.
2015/0291320 A1 10/2015 Ortego
(Continued)

FOREIGN PATENT DOCUMENTS

DE 202005002445 5/2005
DE 20321054 U1 * 12/2005 ..... B65D 33/14

OTHER PUBLICATIONS

Machine translation of DE-20321054-U1.*
(Continued)

*Primary Examiner* — Jes F Pascua
(74) *Attorney, Agent, or Firm* — Philip H. Burrus, IV

(57) ABSTRACT

A bag includes one or more suction cups attached to, or integrated into, a major surface of the bag. The suction cups are configured to allow the bag to be selectively attached to, or detached from, the surface of an object. Examples of such objects include coolers, boats, and refrigerator sidewalls.

20 Claims, 9 Drawing Sheets

(56) References Cited

U.S. PATENT DOCUMENTS

| | | | |
|---|---|---|---|
| 2018/0044065 | A1 | 2/2018 | Lau |
| 2018/0103795 | A1 | 4/2018 | Sinclair |
| 2019/0002185 | A1 | 1/2019 | Carroll |
| 2019/0009806 | A1 | 1/2019 | Vanderberg et al. |
| 2020/0352367 | A1 | 11/2020 | Kennedy et al. |

OTHER PUBLICATIONS

DE20321054U1 Description machine translated on Jan. 16, 2024.*
"Radio-Frequency Welding", Wikipedia; Published prior to filing of present application; Last edited May 5, 2020; Viewed online Apr. 18, 2022 at https://en.wikipedia.org/w/index.php?title=Radio-frequency_welding&oldid=955085655.
"Sections of a Cone: Definition, Properties & Examples", Viewed online Apr. 15, 2022; Unknown exact publication date but believed to be prior to filing of present application; Available online at https://www.embibe.com/exams/sections-of-a-cone/.

* cited by examiner

BAG WITH SURFACE ATTACHMENT DEVICES

CROSS REFERENCE TO PRIOR APPLICATIONS

This application claims priority and benefit under 35 U.S.C. § 119(e) from U.S. Provisional Application No. 63/318,246, filed Mar. 9, 2022, which is incorporated by reference for all purposes.

BACKGROUND

Technical Field

This disclosure relates generally to bags, and more particularly to bags having surface attachment devices that allow the bag to attach to solid surfaces.

Background Art

Coolers are incredible things. A well-designed cooler can keep objects stored therein cool for many days. This is especially true when the cooler is filled with ice. A well-designed cooler can keep the ice from rapidly melting, thereby maintaining food, beverages, and other items stored within the cooler suitably cool for a long time.

One problem associated with such coolers is that to maintain optimal thermal integrity, they must be tightly sealed. Accordingly, when ice melts—albeit slowly—water can accumulate in the bottom of the cooler. When hydrophilic items—such as sandwiches—come into contact with this water, they can become soggy or even disintegrate. It would be advantageous to have a solution to this problem. After all, nobody likes a soggy sandwich.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present disclosure.

Figure 1:
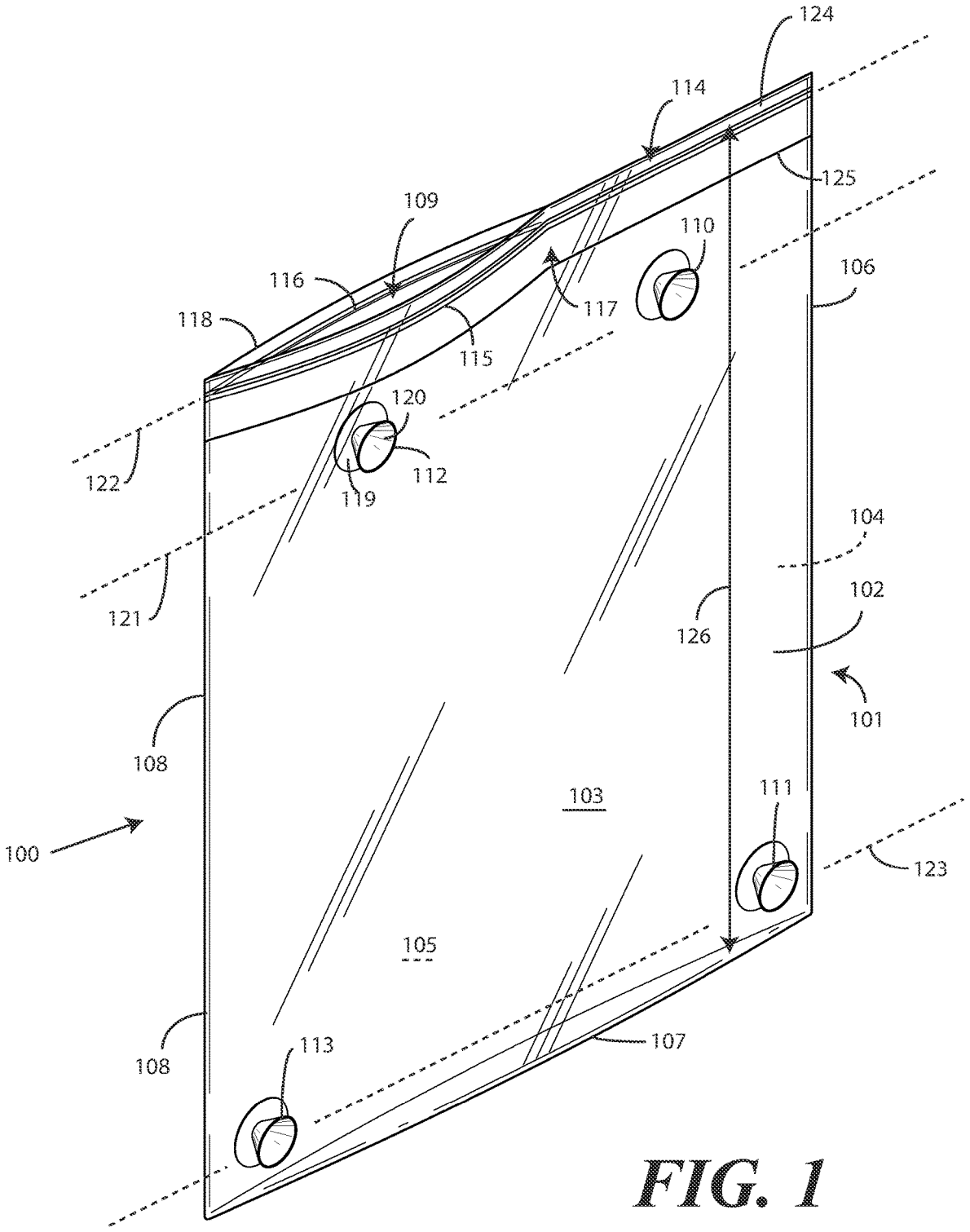
FIG. 1 illustrates a perspective view of one explanatory bag in accordance with one or more embodiments of the disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION OF THE DRAWINGS

Embodiments of the disclosure are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." In this document, relational terms such as first and second, top and bottom, and the like may be used solely to distinguish one entity or action from another entity or action without necessarily requiring or implying any actual such relationship or order between such entities or actions.

As used herein, components may be "operatively coupled" when information can be sent between such components, even though there may be one or more intermediate or intervening components between, or along the connection path. The terms "substantially", "essentially", "approximately", "about" or any other version thereof, are defined as being close to as understood by one of ordinary skill in the art, and in one non-limiting embodiment the term is defined to be within ten percent, in another embodiment within five percent, in another embodiment within one percent and in another embodiment within one-half percent. The term "coupled" as used herein is defined as connected, although not necessarily directly and not necessarily mechanically. Also, reference designators shown herein in parenthesis indicate components shown in a figure other than the one in discussion. For example, talking about a device (10) while discussing figure A would refer to an element, 10, shown in figure other than figure A.

Embodiments of the disclosure relate generally to a sealable bag that can be used in multi-temperature wet or dry locations. In one or more embodiments, a bag manufactured is from a first thermoplastic panel defining a first major surface of the bag and a second thermoplastic panel defining a second major surface of the bag. The first thermoplastic panel and the second thermoplastic panel are joined at one or more side edges so as to define both the sides of the bag and an opening. In one or more embodiments, a zipper lock having a first zipper lock portion attached to the first thermoplastic panel proximately with the opening and a second zipper lock portion attached to the second thermoplastic panel proximately with the opening are selectively attachable to other, thereby allowing the opening to be selectively opened and closed.

In one or more embodiments, one or more suction cups are attached, integrated, or otherwise coupled to a major surface of the bag. Illustrating by example, in one or more embodiments between three and six suction cups are attached to one major surface of the bag while the other major surface of the bag is devoid of suction cups. Advantageously, the provision of suction cups along a major surface of the bag allows the bag to be attached to smooth surfaces such as to the lids of coolers, the sidewalls of refrigerators, the sidewalls of boats or other marine craft, or to other objects.

Illustrating by example, a primary application for bags configured in accordance with embodiments of the disclosure is attachment of a bag to the interior lid of a cooler. Objects that one would like to keep dry, such as sandwiches, can be placed in the bag. When the lower portion of the cooler is contains ice, items within the bag will be kept cool via conductive thermal transfer. However, as the ice melts, the items within the bag will be safely retained well above the resulting water, thereby keeping the same dry. A sandwich placed in the bag with its suction cups attached to the lid will remain cool and fresh, but also dry. Since nobody likes a soggy sandwich, embodiments of the disclosure advantageously prevent the water in a cooler from contacting the sandwich, thereby keeping sandwich lovers happy and satisfied.

Applications for manufactures configured in accordance with embodiments of the disclosure are not limited to only coolers. To the contrary, embodiments of the disclosure provide additional temporary storage space within other objects as well, including refrigerators. If a refrigerated medicine needs to be readily accessible and kept out of contact with food items, embodiments of the disclosure provide a container to do just that. The medicine can be placed within the interior of the bag. The zipper lock can then be closed. The one or more suction cups can then be attached to the interior wall of the refrigerator for both easy access and mechanical isolation from other foods.

Indeed, embodiments of the disclosure can be attached to any number of smooth objects. Watercraft, for example, provide another application. Food, wallets, electronic devices, or other objects can be placed within the bag with the one or more suction cups being attached to the sidewall of kayaks, boats, and watercraft. Embodiments of the disclosure provide a bag having integrated suction cups that can selectively attach to a smooth surface, thereby allowing the bag to be easily moved from place to place and/or attached in a permanent storage location.

Embodiments of the disclosure are directed to the storage and transportation of items that need to remain in cold or warm storage and stay dry. In one or more embodiments, a bag can be used to store or transport foods, medicines, electronics, or other items that must remain dry and kept at cold or warm temperatures. In one or more embodiments, the bag comprises a pouch made of plastic with an opening at one end. A zipper lock is attached to the open end. The zipper lock selectively seals the bag. Attached to the reverse side of the bag are one or more suction cups. These suction cup(s) Are used to attach the bag to smooth surfaces for storage.

In one or more embodiments, the bag is suitable for keeping items dry during cold or warm storage. In one or more embodiments, the bag is suitable for holding items in place during storage.

In one or more embodiments, the one or more suction cups are molded into the bag to provide additional strength and easy storage. In one or more embodiments, the bag advantageously attaches to a smooth surface using the suction cups to provide extra storage area.

In one or more embodiments, the suction cups situated closer to the opening and zipper lock of the bag are closer together (or spaced further from the edges of the bag) than are suction cups situated farther from the opening and zipper lock of the bag. This configuration advantageously allows easier access to items situated inside the bag.

In one or more embodiments, the bag is made of a pellucid material. By being essentially transparent, the pellucid material allows contents situated within the bag to be easily identified.

Turning now to FIG. 1, illustrated therein is one explanatory manufacture 100 configured in accordance with embodiments of the disclosure. As used herein, "manufacture" takes the term of art found in MPEP § 2106,03, which is "a tangible article that is given a new form, quality, property, or combination through man-made or artificial means." See, e.g., *Digitech Image Techs. V. Electronics for Imaging,* 758 F.3d 1344, 1349 (Fed. Cir. 2014), citing *Diamond v. Chakrabarty,* 447 US 303, 308 (1980). "As the courts have explained, manufactures are the result from the process of manufacturing, i.e., they were produced 'from raw or prepared materials by giving to these materials new forms, qualities, properties, or combinations, whether by hand-labor or by machinery.'" *Samsung Electronics Co. v. Apple Inc.,* 580 US_, 137 S. Ct. 429, 435 (2016), quoting *Diamond v. Chakrabarty,* 447 US at 308.

In one or more embodiments, the manufacture 100 comprises a bag 101 having a first thermoplastic panel 102 defining a first major surface 103 serving as a front face of the bag 101 and a second thermoplastic panel 104 defining a second major surface 105 serving as a rear face of the bag 101. In one or more embodiments, the first thermoplastic panel 102 and the second thermoplastic panel 104 are manufactured from polyvinyl chloride (PVC), although other materials can be used as well. Examples of such other materials include chlorinated polyvinyl chloride (CPVC), polyurethane, nylon, cellulose acetate, ethylene-vinyl acetate (EVA), polyethylene terephthalate (PET), and polyvinylidene chloride (PCDC).

In one or more embodiments, these materials work well because the first thermoplastic panel 102 and the second thermoplastic panel 104 are mechanically joined together along three side edges 106,107,108 by radio frequency (RF) welding. Radio frequency welding takes advantage of a dipole in these materials to generate heat. Accordingly, when radio frequency welding is used to join the first thermoplastic panel 102 to the second thermoplastic panel 104, the thermoplastic material selected should include an electrical dipole. In other embodiments, however, the first thermoplastic panel 102 can be joined to the second thermoplastic panel 104 by other coupling methods, examples of which includes thermal welding or sonic welding. Where such processes are used to join the three side edges 106,107,108, materials such as polystyrene or polyethylene film can be used for the first thermoplastic panel 102 and/or the second thermoplastic panel 104. Still other materials and coupling methods will be obvious to those of ordinary skill in the art having the benefit of this disclosure.

In one or more embodiments, each of the first thermoplastic panel 102 and the second thermoplastic panel 104 has a thickness of between 20 and 40 mils (0.020 to 0.040 inches). Experimental testing has determined that such thicknesses are not only well suited for accommodating the attachment of the first thermoplastic panel 102 to the second thermoplastic panel 104 using a radio frequency welding process, but also for protecting any contents stored within the bag 101. Additionally, these thicknesses are robust enough to allow objects to be radio frequency welded to either the first thermoplastic panel 102 or the second thermoplastic panel 104, examples of which include the one or more suction cups 110,111,112,113 shown attached to the first thermoplastic panel 102 in FIG. 1.

In one or more embodiments, the thickness of the first thermoplastic panel 102 and the second thermoplastic panel 104 is selected so as to have the necessary and requisite strength characteristics to not only withstand a radio frequency welding process, but also to contain and protect items stowed within the bag 101, examples of which include food, electronic devices, medicines, wallets, jewelry, money, or other personal belongings. Other applications, as well as items that may be stored within the bag 101, will be obvious to those of ordinary skill in the art having the benefit of this disclosure.

In one or more embodiments, each of the first thermoplastic panel 102 and the second thermoplastic panel 104 is rectangular in shape. In the illustrative embodiment of FIG. 1, both the first thermoplastic panel 102 and the second thermoplastic panel 104 are rectangular, with the same being joined together at three side edges 106,107,108 by radio frequency welding. Joining the first thermoplastic panel 102 and the second thermoplastic panel 104 at only three side edges 106,107,108 allows the first thermoplastic panel 102 and the second thermoplastic panel 104 to define an opening 109 for the bag 101.

In one or more embodiments, the bag 101 includes a zipper lock 114 that is selectively closable so as to selectively open and close the opening 109 of the bag 101. Illustrating by example, in one or more embodiments a first zipper lock portion 115 is attached to the first thermoplastic panel 102 at a location 117 that is situated proximally with the opening 109. Similarly, a second zipper lock portion 116 is attached to the second thermoplastic panel 104 at a location 118 that is also situated proximally with the opening 109. In one or more embodiments, the first zipper lock portion 115 is selectively attachable to, and releasable from, the second zipper lock portion 116 to selectively open, and close, the opening 109 of the bag 101, respectively. While a zipper lock 114 is one suitable closure for the bag 101, others will be obvious to those of ordinary skill in the art having the benefit of this disclosure.

Figure 8:
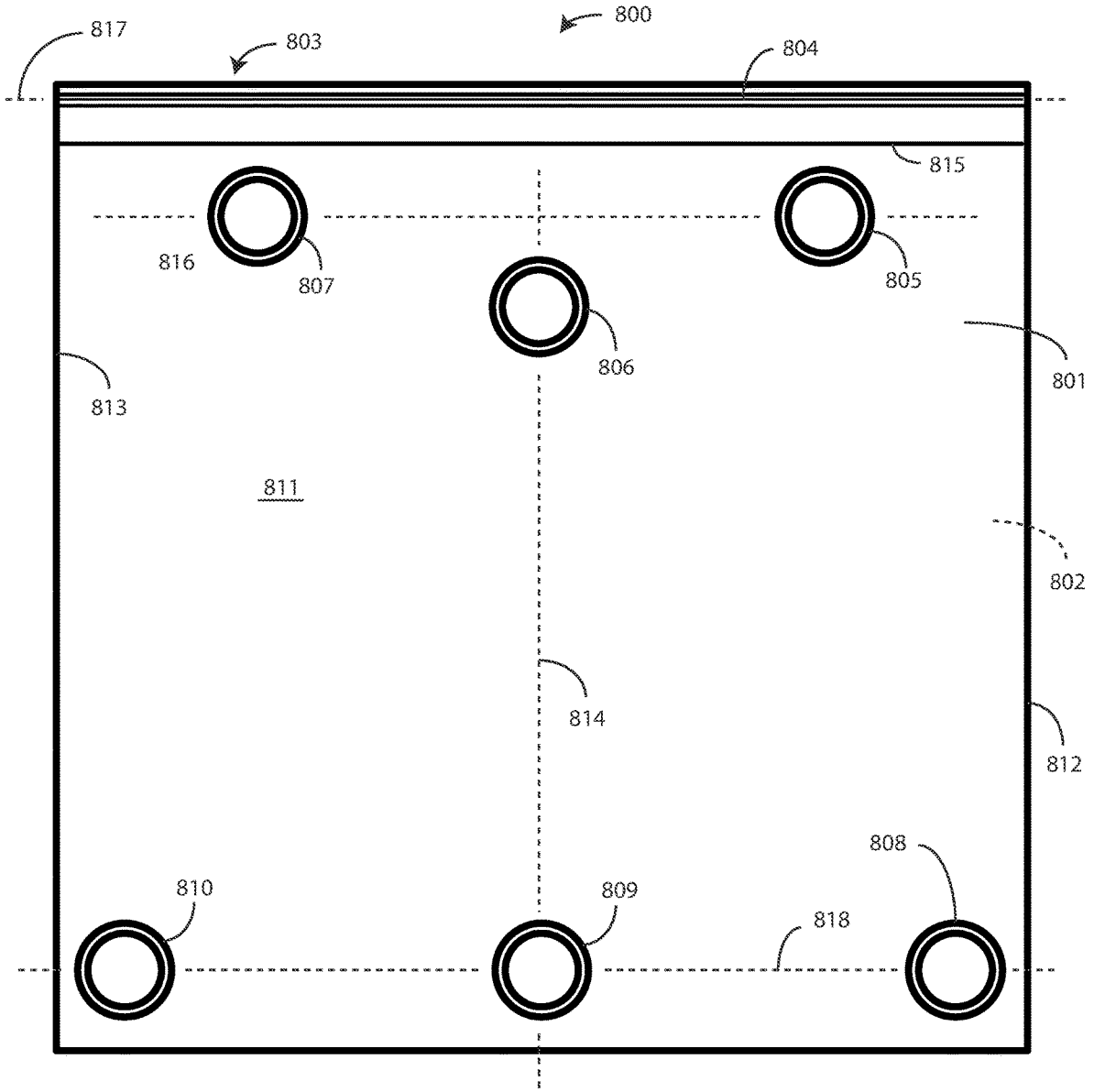
FIG. 8 illustrates a front elevation view of one explanatory larger bag in accordance with one or more embodiments of the disclosure.

As shown in FIG. 1, in one or more embodiments one or more suction cups 110,111,112,113 are attached to, or integrated into, the major surface 103 of the bag defined by the first thermoplastic panel 102. While the number of suction cups 110,111,112,113 can vary, embodiments of the disclosure contemplate that for general applications the number of suction cups 110,111,112,113 will range from between three suction cups and six suction cups. Illustrating by example, in the illustrative embodiment of FIG. 1 four suction cups 110,111,112,113 are attached to the first thermoplastic panel 102. However, as will be described below with reference to FIG. 6, in other embodiments three suction cups can be used. In FIG. 8 below, six suction cups are employed, and so forth.

In one or more embodiments, the one or more suction cups 110,111,112,113 are coupled only to one of the first thermoplastic panel 102 or the second thermoplastic panel 104, and not the other. Illustrating by example, in FIG. 1 the four suction cups 110,111,112,113 are coupled only to the major surface 103 defined by the first thermoplastic panel 102, while the second thermoplastic panel 104 is devoid of suction cups. This arrangement provides an intuitive instructional device in that a user instinctively understands that the first thermoplastic panel 102 is the one that should be attached to a smooth surface rather than the second thermoplastic panel 104. Thus, if the first thermoplastic panel 102 is manufactured from a thicker material than the second thermoplastic panel 104 to provide suspension strength, placement of the four suction cups 110,111,112,113 on the first thermoplastic panel 102 ensures that the first thermoplastic panel 102 will be the suspension surface and not the second thermoplastic panel 104.

In the illustrative embodiment of FIG. 1, the four suction cups 110,111,112,113 are attached to the first thermoplastic panel 102 by radio frequency welding. As will be described in more detail with reference to FIG. 4 below, in one or more embodiments each suction cup 110,111,112,113 includes a base 119 from which the sidewalls 120 of the suction cup extend distally. In one or more embodiments, the base 119 is attached to the major surface 103 defined by the first thermoplastic panel by a radio frequency welding process. While the four suction cups 110,111,112,113 are attached to the first thermoplastic panel 102 by radio frequency welding in FIG. 1, in other embodiments the first thermoplastic panel 102 itself will define the four suction cups 110,111,112,113. Illustrating by example, the first thermoplastic panel 102 may define recesses of thickened material situated where the bases 119 of the four suction cups 110,111,112,113 are shown in FIG. 1, with each recess of thickened material serving the function of the sidewalls 120.

In FIG. 1, the four suction cups 110,111,112,113 are arranged in a unique manner. Specifically, a first suction cup 110 and a second suction cup 112 are situated more proximally with the zipper lock 114 than are a third suction cup 111 and a fourth suction cup 113, which are situated more distally from the zipper lock 114. Additionally, the first suction cup 110 and the second suction cup 112 are situated closer together than are the third suction cup 111 and the fourth suction cup 113. This closer positioning of the first suction cup 110 and the second suction cup 112 allows the opening 109 of the bag 101 to more easily be opened when the four suction cups 110,111,112,113 are attached to a smooth surface. The wider separation between the third suction cup 111 and the fourth suction cup 113 provides increased stability for objects situated within the bag 101.

In this illustrative embodiment, the first suction cup 110 and the second suction cup 112 are arranged along a suction cup arrangement axis 121 that is oriented parallel with a major axis 122 of the zipper lock 114. Similarly, the third suction cup 111 and the fourth suction cup 113 are arranged along another suction cup arrangement axis 123 that is also oriented parallel with the major axis 122 of the zipper lock 114. In this illustrative embodiment, the bag 101 defines a square shape having a major dimension 126 of ten inches.

In one or more embodiments, the polyvinyl chloride defining the first thermoplastic panel 102 and the second thermoplastic panel 104 are formed using an extrusion process. In one embodiment, the first thermoplastic panel 102 and the second thermoplastic panel 104 are initially two separate layers of material that are then sealed together using a radio frequency welding process that seals the three side edges 106,107,108 of the first thermoplastic panel 102 and the second thermoplastic panel 104 together. However, in other embodiments the first thermoplastic panel 102 and the second thermoplastic panel 104 can be portions of a single, unitary layer of material that is folded such that the fold defines one of the three side edges 106,107,108. The two remaining edges of the three side edges 106,107,108 can then be sealed together using the radio frequency welding process, and so forth.

In still other embodiments, the bag 101 can be manufactured by extruding the polyvinyl chloride in a tubular manner. The tube can then be flattened, with flat portions of the tube defining the first thermoplastic panel 102, the second thermoplastic panel 104, and with folds in the tube defining two side edges 106,108. The third side edge 107 can then be created by welding the bottom portion of the tube together. These portions can be manufactured as a part of a continuous web, with individual bags being severed from the continuous web after several steps of the manufacturing process.

In one or more embodiments, the polyvinyl chloride defining the first thermoplastic panel 102 and the second thermoplastic panel 104 is transparent, translucent, or pellucid. In one or more embodiments, the material defining the first thermoplastic panel 102 and the second thermoplastic panel 104 is also flexible. Each of the first thermoplastic panel 102 and the second thermoplastic panel 104 have an inner surface that may contact items positioned within the cavity defined by the bag 101. The first thermoplastic panel 102 and the second thermoplastic panel 104 then have external surfaces to which objects such as the one or more suction cups 110,111,112,113 can be attached. Handles or other graspable articles can be attached to the exterior surfaces of one or both of the first thermoplastic panel 102 and/or the second thermoplastic panel 104 as well.

A receptacle or cavity is defined by the inner surfaces of the first thermoplastic panel 102 and the second thermoplastic panel 104. This cavity can be sealed by pressing the first zipper lock portion 115 and the second zipper lock portion 116 together.

In one or more embodiments, the first thermoplastic panel 102 and the second thermoplastic panel 104 define an extended lip 124 that extends distally beyond the zipper lock 114. In one or more embodiments, the extended lip 124 provides a graspable portion of the first thermoplastic panel 102 and the second thermoplastic panel 104 situated on the opposite side of the zipper lock 114 from the cavity of the bag 101 that a user can grasp and open the bag by separating the first zipper lock portion 115 from the second zipper lock portion 116.

In one or more embodiments, the zipper lock 114 is attached to the bag 101 by a radio frequency weld 2. In one or more embodiments, the zipper lock 114 has two halves, which are defined by the first zipper lock portion 115 and the second zipper lock portion 116. In one or more embodiments, the first zipper lock portion 115 is attached to the first thermoplastic panel 102 by a first radio frequency weld, while the second zipper lock portion 116 is attached to the second thermoplastic panel 104 with a second radio frequency weld. A zipper lock seam 125 can also be RF welded to the bag 101 where desired.

As noted above, in one or more embodiments the one or more suction cups 110,111,112,113 are attached to the first thermoplastic panel 102 by radio frequency welding a base 119 of each suction cup 110,111,112,113 to the first thermoplastic panel 102. However, the one or more suction cups 110,111,112,113 can be attached to the first thermoplastic panel 102 by other techniques as well.

Illustrating by example, in other embodiments the base 119 of each suction cup 110,111,112,113 can be adhesively attached to the major surface 103 of the bag 101 defined by the first thermoplastic panel 102. In still other embodiments, each suction cup 110,111,112,113 can be integrated into, or defined by, the major surface 103 of the bag 101 defined by the first thermoplastic panel 102 as previously mentioned. Other techniques for attaching or integrating one or more suction cups 110,111,112,113 into the bag will be obvious to those of ordinary skill in the art having the benefit of this disclosure.

In one or more embodiments, a front major surface of the bag 101 and a rear major surface of the bag 101 are closed on one side edge 106 by radio frequency welding. Similarly, the front major surface of the bag 101 and the rear major surface of the bag 101 are closed on the other side edge 108 by another radio frequency weld. The bottom side edge 107 of the front major surface of the bag 101 and the rear major surface of the bag 101 can also be closed by radio frequency welding.

As noted above, in one or more embodiments the bag 101 is manufactured from a pellucid, clear, or transparent plastic material so that contents situated therein can be clearly seen through the first thermoplastic panel 102 and/or second thermoplastic panel 104. As noted above, in one or more embodiments first suction cup 110 and the second suction cup 112 are situated closer to the opening 109 and zipper lock 114 of the bag 101 and are closer together (or spaced further from side edges 106,108 of the bag 101) than are the third suction cup 111 and fourth suction cup 113, which are situated farther from the opening 109 and zipper lock 114 of the bag 101. This configuration advantageously allows easier access to items situated inside the bag 101.

Figure 2:
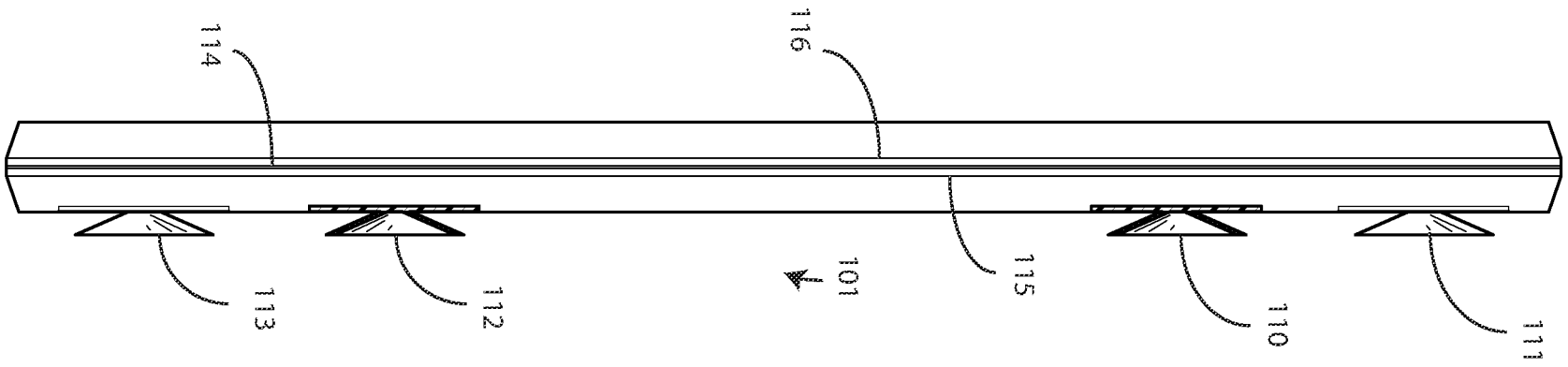
FIG. 2 illustrates a top view of one explanatory bag in accordance with one or more embodiments of the disclosure.

Turning now to FIG. 2, illustrated therein is a top view of one embodiment of a bag 101 configured in accordance with embodiments of the disclosure. As shown in FIG. 2, the selective attachment of the first zipper lock portion 115 to the second zipper lock portion 116 allows for easy opening and closing of the bag 101. Pulling one side of the zipper lock 114 away from the other opens the bag 101, while pressing the one side of the zipper lock 114 against the other seals the bag 101.

Also shown in FIG. 2 are the different spacings between the one or more suction cup 110,111,112,113. As shown, the first suction cup 110 is closer to the second suction cup 112 than the third suction cup 111 is to the fourth suction cup 113.

Figure 3:
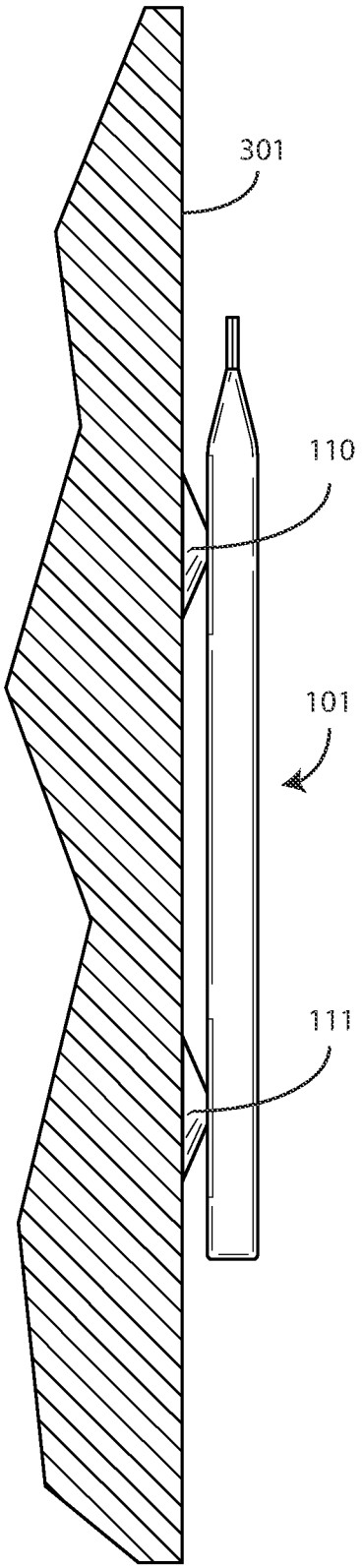
FIG. 3 illustrates a side elevation view of one explanatory bag configured in accordance with one or more embodiments of the disclosure coupled to a solid surface.

Turning now to FIG. 3, the bag is shown with the suction cups 110,111 attached to a flat, smooth surface 301. As noted above, the flat, smooth surface 301 to which the suction cups 110,111 can attach can vary. The bag 101 of FIG. 3 is well suited to attaching to a cooler sidewall. However, it should be noted that the suction cups 110,111 of FIG. 3 could also be attached to surfaces of refrigerators, sides of boats, sides of kayaks, or to other smooth surfaces.

Figure 4:
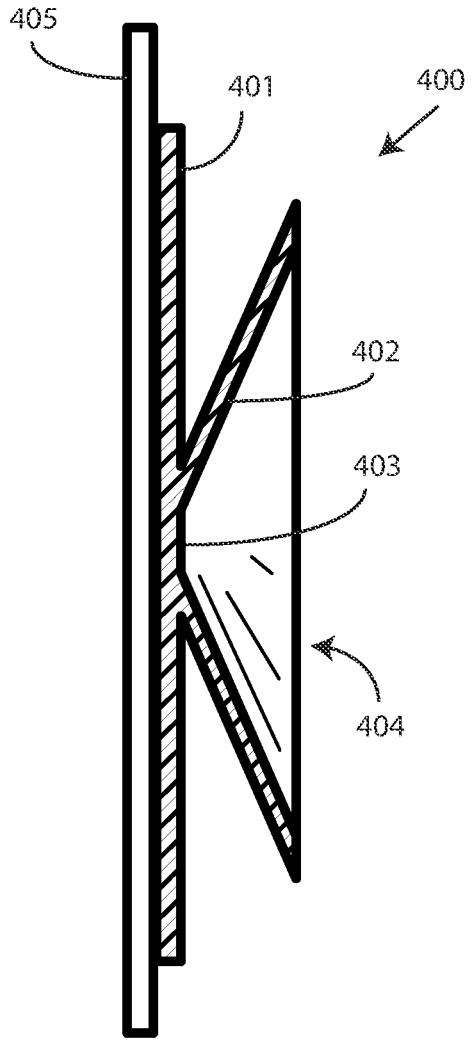
FIG. 4 illustrates one explanatory suction cup suitable for use with a bag configured in accordance with one or more embodiments of the disclosure.
Figure 5:
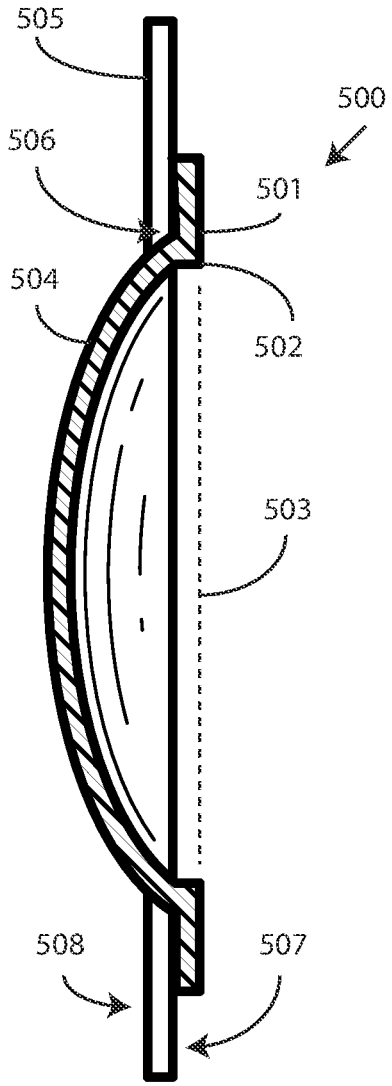
FIG. 5 illustrates another explanatory suction cup suitable for use with a bag configured in accordance with one or more embodiments of the disclosure.

Turning now to FIGS. 4 and 5, illustrated therein are two explanatory suction cups 400,500. The suction cup 400 of FIG. 4 provides an example of a suction cup that can be used as one of the suction cups (110,111,112,113) of FIGS. 1-3. The suction cup 500 of FIG. 5 illustrates an alternate suction cup that can be substituted for one of the suction cups (110,111,112,113) of FIGS. 1-3. Of course, the suction cup 400 of FIG. 4 and the suction cup 500 of FIG. 5 could be used in various combinations on a single bag as well.

Beginning with FIG. 4, in one or more embodiments a suction cup 400 defines a base 401 from which sidewalls 402 of the suction cup 400 extend distally. As shown in FIG. 4, in one or more embodiments these sidewalls 402 are substantially straight and taper or extend distally outward from an apex 403 of the sidewalls 402 to a nappe 404 defined by the sidewalls 402 of the suction cup 400. The base 401 can then be attached to a major surface 405 of a thermoplastic panel by radio frequency welding or by other techniques.

In one or more embodiments, the sidewalls 402 and the base 401 are configured as a singular, unitary component. In other embodiments, the sidewalls 402 can be attached to the base 401, which is planar in this illustrative embodiment. In one or more embodiments, the same of the sidewalls 402 define a conical shell extending distally from the base 401 to the nappe 404.

In one or more embodiments, the undersurface of the base 401 (disposed on the opposite side from the sidewalls 402) can be textured or otherwise patterned so as to make attachment of the base 401 to the major surface 405 of the thermoplastic panel more efficient. Where adhesive attachment or another type of attachment other than radio frequency welding is used, an adhesive coating may be applied between the base 401 and the major surface 405 of the thermoplastic panel. In one or more embodiments, the entire suction cup 400 is integrally formed using an injection molding process from a flexible material such as vinyl plastic.

In one or more embodiments, distal ends of the sidewalls 402 situated at the nappe 404 are substantially planar. To facilitate the release of suction force imposed by the sidewalls 402, a friction reducing coating may be applied to one or more surfaces of the suction cup 400. In one or more embodiments, the sidewalls 402 are configured to apply a suction force to retain the suction cup 400 against flat, smooth surfaces such as the interior surfaces of coolers, the interior surfaces of refrigerators, the sidewalls of boats, kayaks, paddleboards, jet skis, or other watercraft, sidewalls of tractors, cars, and other vehicles, windows, glass surfaces, or other substantially flat and substantially smooth surfaces. In one or more embodiments, the suction force applied by the sidewalls 402 is sufficient to retain a bag (101) such as that shown and described above with reference to FIGS. 1-3 to such a surface when contents, be they electronics, food, beverages, ice, personal items, or otherwise, are situated within the cavity of the bag (101).

While the sidewalls 402 are shown being straight in FIG. 4, they can take other forms as well, including the U-shape shown in FIG. 5. The coefficient of friction between the sidewalls 402 and the flat, smooth surface (301) to which the suction cup 400 is attached ensures that contents positioned within a bag (101) configured in accordance with embodiments of the disclosure will be robustly retained to the surface without falling. As noted above, the base 401 can be attached to a major surface 405 of a thermoplastic panel by radio frequency welding, adhesively coupling, or by other techniques.

Turning now to FIG. 5, in this embodiment rather than having a base member the suction cup 500 includes a flange 501 extending distally from a perimeter 502 of a nappe 503 defined by the sidewalls 504 of the suction cup 500. Where so configured, the major surface 505 of the thermoplastic panel can define an aperture 506 into which the sidewalls 504 of the suction cup 500 situate.

Thereafter, the flange 501 can be attached to a first side 507 of the major surface 505 of the thermoplastic panel, while the sidewalls 504 of the suction cup 50 extend distally through the corresponding aperture 506 to a second side 508 of the major surface 505 of the thermoplastic panel. Thus, when the major surface 505 of the thermoplastic panel defines a major surface of a bag configured in accordance with embodiments of the disclosure, the sidewalls 504 of the suction cup 500 situate on the interior side of the bag within the cavity defined by the major surface 505 of the thermoplastic panel, while the flange 501 situates on the exterior side of the bag on the exterior surface of the major surface 505 of the thermoplastic panel. Said differently, the flange 501 is mechanically attached to the exterior surface of the major surface 505 of the thermoplastic panel at a perimeter of the aperture 506, while the sidewalls 504 then extend distally through the aperture 506 toward an interior of the bag defined by the major surface 505 of the thermoplastic panel.

As noted above, in still other embodiments, the major surface of the bag itself defines the suction cup by defining a concave recess that functions as a suction cup device. Other techniques for integrating the suction cups into the bag or attaching the same thereto will be obvious to those of ordinary skill in the art having the benefit of this disclosure.

Figure 6:
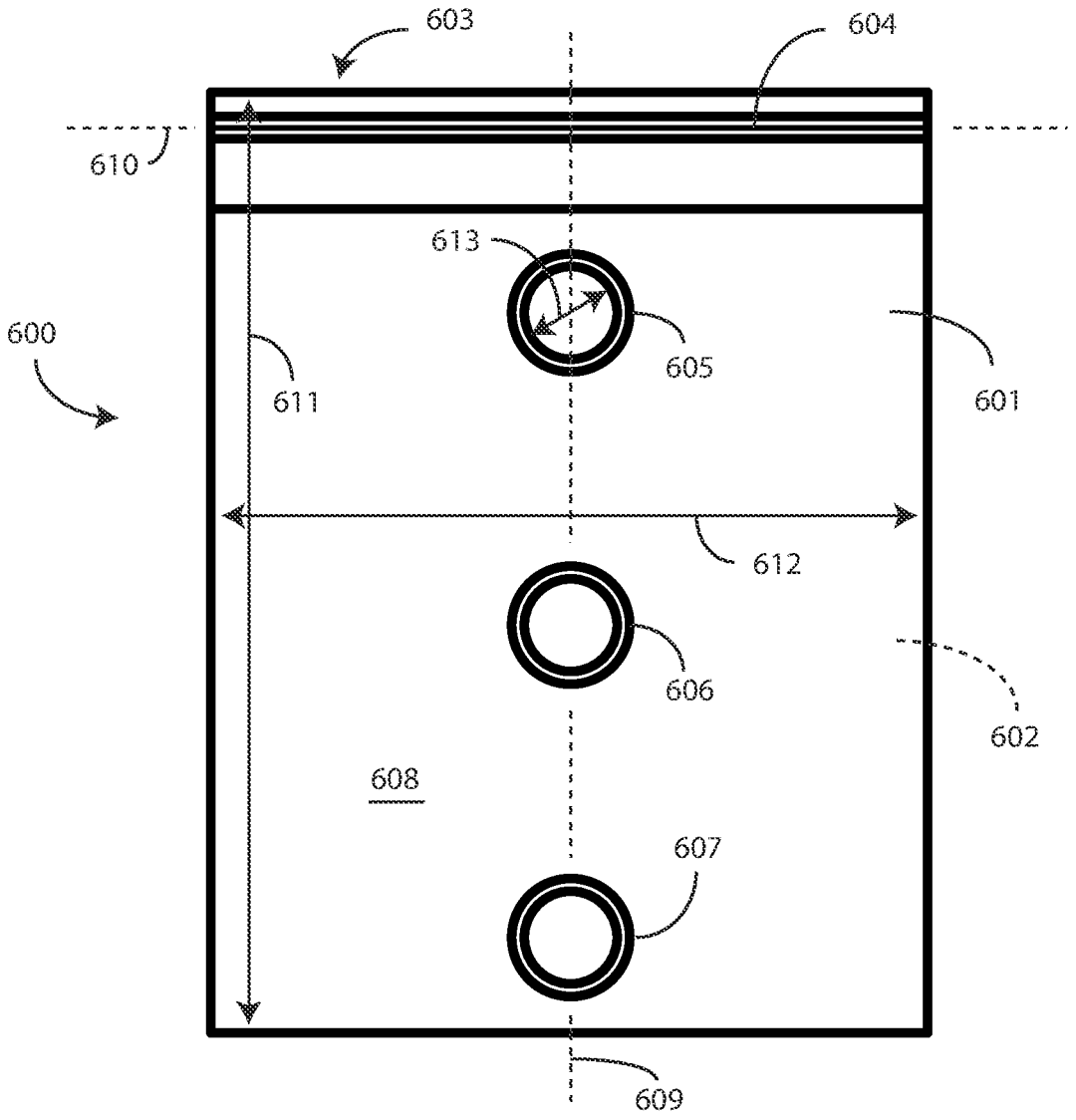
FIG. 6 illustrates a front elevation view of one explanatory smaller bag in accordance with one or more embodiments of the disclosure.
Figure 7:
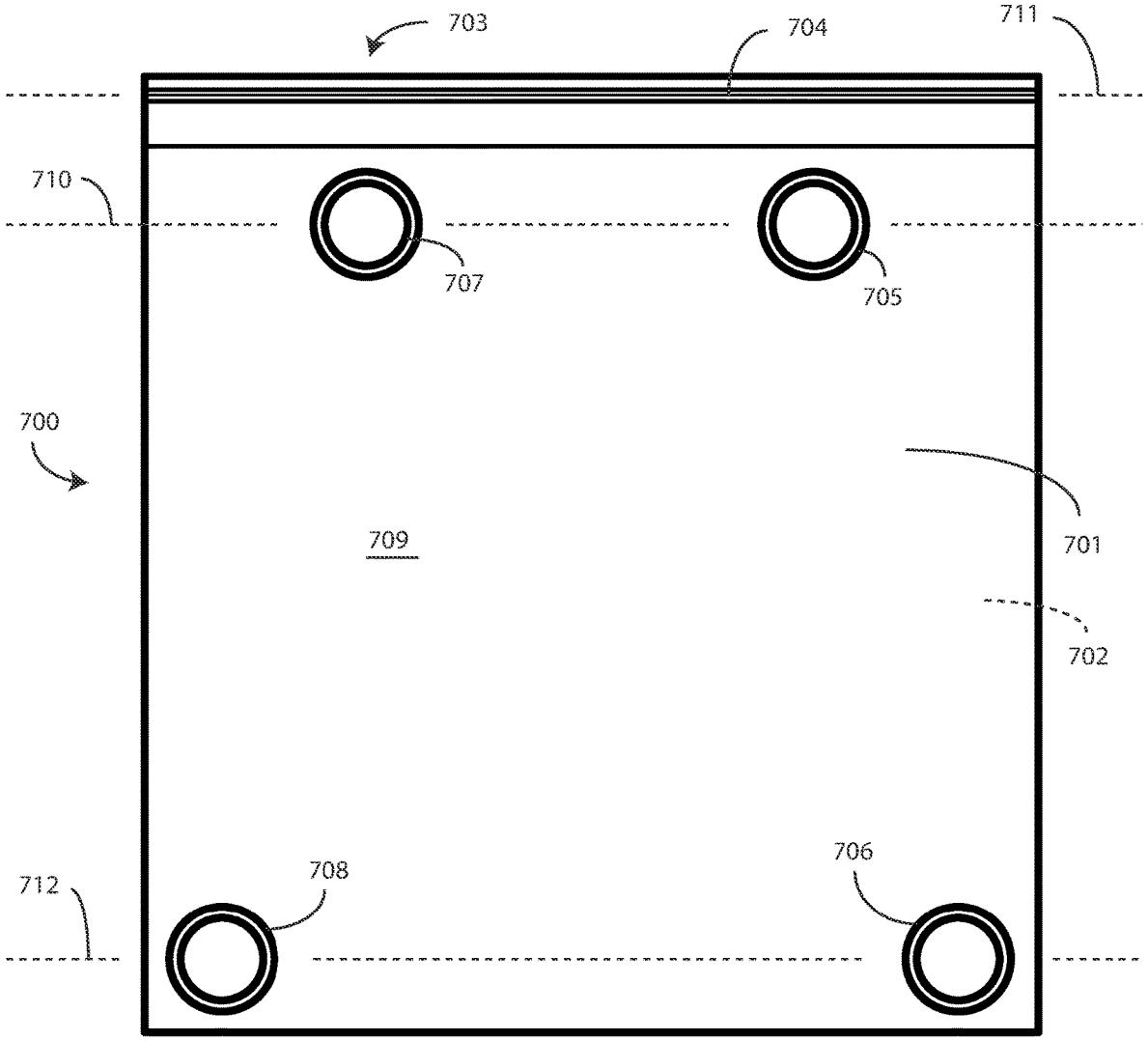
FIG. 7 illustrates a front elevation view of one explanatory mid-size bag in accordance with one or more embodiments of the disclosure.

Turning now to FIGS. 6-8, illustrated therein are three different explanatory bags 600,700,800 configured in accordance with embodiments of the disclosure. The bag 600 of FIG. 6 is a "small" bag, suitable for containing a mobile phone or other similarly sized article. The bag 700 of FIG. 7 is a "medium" bag and is suitable for holding a lunch meal or other similarly sized item or items. The bag 800 of FIG. 8 is a larger bag and is suitable for holding light garments or other personal articles. A user may employ the larger bag 800 of FIG. 8 to hold articles and for attachment to a paddleboard during an excursion, for example.

Beginning with FIG. 6, illustrated therein is a bag 600 comprising a first panel 601 that is attached to a second panel 602. The first panel 601 and second panel 602 can be manufactured from a clear, flexible thermoplastic such as polyvinyl chloride and can be radio frequency welded together as described above with reference to FIG. 1 to define the bag 600 and its opening 603. A closure 604, shown here as a zipper lock, can be attached to the opening 603 to allow the bag 600 to be selectively opened and closed.

In this illustrative embodiment, a plurality of suction cups 605,606,607 are attached to an exterior surface 608 of the first panel 601. In this illustrative embodiment, the plurality of suction cups 605,606,607 consists of exactly three suction cups. All suction cups 605,606,607 are arranged along a suction cup arrangement axis 609 that is oriented orthogonally with a major axis 610 of the closure 604.

In this illustrative embodiment, the bag 600 has a major axis 611 of about six and one-half inches. The bag 600 also has a minor dimension 612 of about five inches. Each suction cup 605,606,607 has a nappe with a diameter 613 of about thirty millimeters. The circumference of the perimeter of the base of each suction cup 605,606,607 is larger than the perimeter of each nappe in this illustrative embodiment.

In one or more embodiments, the three suction cups 605,606,607 are evenly positioned along the exterior surface 608 of the bag 600. In this illustrative embodiment, the center of the first suction cup 605 is positioned between 1.5 inches and 1.6 inches from the top of the bag 600. In one or more embodiments, the center of the first suction cup 605 is positioned 1.5250 inches from the top of the bag 600.

In this illustrative embodiment, the center of the third suction cup 607 is positioned between 0.62 inches and 0.63 inches from the bottom of the bag 600. In one or more embodiments, the center of the third suction cup 607 is positioned 0.625 inches from the bottom of the bag 600. While other dimensions for the bag 600 can be used, examples of which will be described below with reference to FIGS. 7 and 8, experimental testing confirms that the illustrative dimensions and suction cup placement shown in FIG. 6 is well suited for using the bag 600 to protect a cellular phone or other similarly sized article.

Turning now to FIG. 7, illustrated therein is another bag 700 configured in accordance with one or more embodiments of the disclosure. As before, the bag 700 comprises a first panel 701 that is attached to a second panel 702. The first panel 701 and second panel 702 are manufactured from a clear, flexible thermoplastic such as polyvinyl chloride and are radio frequency welded together to define the bag 700 and its opening 703. A closure 704, shown again as a zipper lock, can be attached to the opening 703 to allow the bag 700 to be selectively opened and closed. While a zipper lock is again used as an illustrative closure 704 for discussion, it should be noted that the zipper lock could be replaced with other closures, including adhesive closures, drawstring closures, electrostatic closures, mechanical clasps or clips that attach to outer surface of the first panel 701 and second panel 702, and so forth. Other examples of closures 704 will be obvious to those of ordinary skill in the art having the benefit of this disclosure.

In this illustrative embodiment, a plurality of suction cups 705,706,707,708 are attached to an exterior surface 709 of the first panel 701. In one or more embodiments, the plurality of suction cups attached to the exterior surface 709 of the first panel 701 comprises at least four suction cups. In the illustrative embodiment of FIG. 7, the plurality of suction cups 705,706,707,708 comprises exactly four suction cups.

As shown, a first suction cup 705 and a second suction cup 707 are situated closer together and closer to the opening 703 than are a third suction cup 706 and a fourth suction cup 708. In this illustrative embodiment, the first suction cup 705 and the second suction cup 707 are arranged along a suction cup arrangement axis 710 oriented parallel with a major axis 711 of the closure 704. Similarly, the third suction cup 706 and the fourth suction cup 708 are arranged along another suction cup arrangement axis 712 that is also oriented parallel with the major axis 711 of the closure 704.

Rather than being rectangular with different major and minor dimensions as was the case with the bag (600) of FIG. 6, in this illustrative embodiment, the bag 700 is square in shape having a major dimension of about ten inches. Said differently, in this illustrative embodiment the first panel 701 and the second panel 702 each define a square having a major dimension of ten inches. Each suction cup 705,706,707,708 again has a nappe with a diameter of about thirty millimeters. The circumference of the perimeter of the base of each suction cup 705,706,707,708 is again larger than the perimeter of each nappe in this illustrative embodiment.

To illustrate the fact that the upper suction cups are closer together than are the lower suction cups, in this illustrative embodiment the center of the first suction cup 705 is positioned between 2.4 inches and 2.6 inches from the right edge of the bag 700. The second suction cup 707 is similarly positioned with reference to the left side of the bag 700. In one or more embodiments, the center of the first suction cup 705 is positioned 2.5 inches from the right edge of the bag 700.

By contrast, the third section cup 706 is positioned between 0.87 inches and 0.088 inches from the right edge of the bag 700. The fourth suction cup 708 is similarly positioned with reference to the left side of the bag 700. In one or more embodiments, the center of the third suction cup 706 is positioned 0.875 inches from the right edge of the bag 700.

Turning now to FIG. 8, illustrated therein is yet another bag 800 configured in accordance with one or more embodiments of the disclosure. As before, the bag 800 comprises a first panel 801 that is attached to a second panel 802. The first panel 801 and second panel 802 are coupled together at their edges to define the bag 800 and its opening 703. A closure 804 is attached to the opening 803 to allow the bag 800 to be selectively opened and closed. The closure 804 can be a zipper lock or other type of closure, as previously described.

In this illustrative embodiment, a plurality of suction cups 805,806,807,808,809,810 are attached to an exterior surface 811 of the first panel 801. In the illustrative embodiment of FIG. 8, the plurality of suction cups 805,806,807,808,809,810 consist of six suction cups.

As shown, a first suction cup 805 is situated between a first edge 812 of the bag 800 and a second suction cup 806. A third suction cup 807 is situated between a second edge 813 of the bag 800 and the second suction cup 806.

A fourth suction cup 808 is situated between the first edge 812 of the bag 800 and a fifth suction cup 809. A sixth suction cup 810 is situated between the second edge 813 of the bag 800 and the fifth suction cup 809.

In this illustrative embodiment, the first suction cup 805, the second suction cup 806, and the third suction cup 806 are all situated more proximally with the closure 804 than are the fourth suction cup 808, the fifth suction cup 809, and the sixth suction cup 810. Additionally, the first suction cup 805 and the third suction cup 807 are situated closer together than are the fourth suction cup 808 and the sixth suction cup 810.

In this illustrative embodiment the second suction cup 806 and the fifth suction cup 809 are arranged along a first suction cup arrangement axis 814 oriented orthogonally with a major axis of the closure 804. Moreover, the second suction cup 806 is farther from the closure 804 than are the first suction cup 805 and the third suction cup 807. In one or more embodiments, the second suction cup 806 is situated more than twice as far from the closure 804 than are the first suction cup 805 and the third suction cup 807. Illustrating by example, in one or more embodiments where the center of the first suction cup 805 is positioned 0.875 inches from the closure seam 815, the center of the second suction cup 806 may be positioned two inches from the closure seam 815.

As shown, a first suction cup 805 and a second suction cup 807, which are the outermost, upper suction cups, are again situated closer together and closer to the opening 803 than are the fourth suction cup 808 and the sixth suction cup 810, which are the outermost, lower suction cups. In this illustrative embodiment, the first suction cup 805 and the third suction cup 807 are arranged along a suction cup arrangement axis 816 oriented parallel with a major axis 817 of the closure 804. Similarly, the fourth suction cup 808, the fifth suction cup 809, and the sixth suction cup 810 are arranged along another suction cup arrangement axis 818 that is also oriented parallel with the major axis 817 of the closure 804. However, the third suction cup 806 is situated farther from the opening 803 than the first suction cup 805 and the third suction cup 807, but closer to the opening 803 than any of the fourth suction cup 808, the fifth suction cup 809, and the sixth suction cup 810.

Rather than being rectangular with different major and minor dimensions as was the case with the bag (600) of FIG. 6, in this illustrative embodiment, the bag 800 is square in shape having a major dimension of about twelve inches. Said differently, in this illustrative embodiment the first panel 801 and the second panel 802 each define a square having a major dimension of twelve inches. Each suction cup 805,806,807,808,809,810 again has a nappe with a diameter of about thirty millimeters. The circumference of the perimeter of the base of each suction cup 805,806,807,808,809,810 is again larger than the perimeter of each nappe in this illustrative embodiment.

To illustrate the fact that the outermost, upper suction cups are closer together than are the lower suction cups, in this illustrative embodiment the center of the first suction cup 805 is positioned between 2.4 inches and 2.6 inches from the right edge of the bag 800. The third suction cup 807 is similarly positioned with reference to the left side of the bag 800. In one or more embodiments, the center of the first suction cup 805 is positioned 2.5 inches from the right edge of the bag 800.

By contrast, the fourth section cup 808 is positioned between 0.87 inches and 0.088 inches from the right edge of the bag 800. The sixth suction cup 810 is similarly positioned with reference to the left side of the bag 800. In one or more embodiments, the center of the fourth suction cup 808 is positioned 0.875 inches from the right edge of the bag 800.

Figure 9:
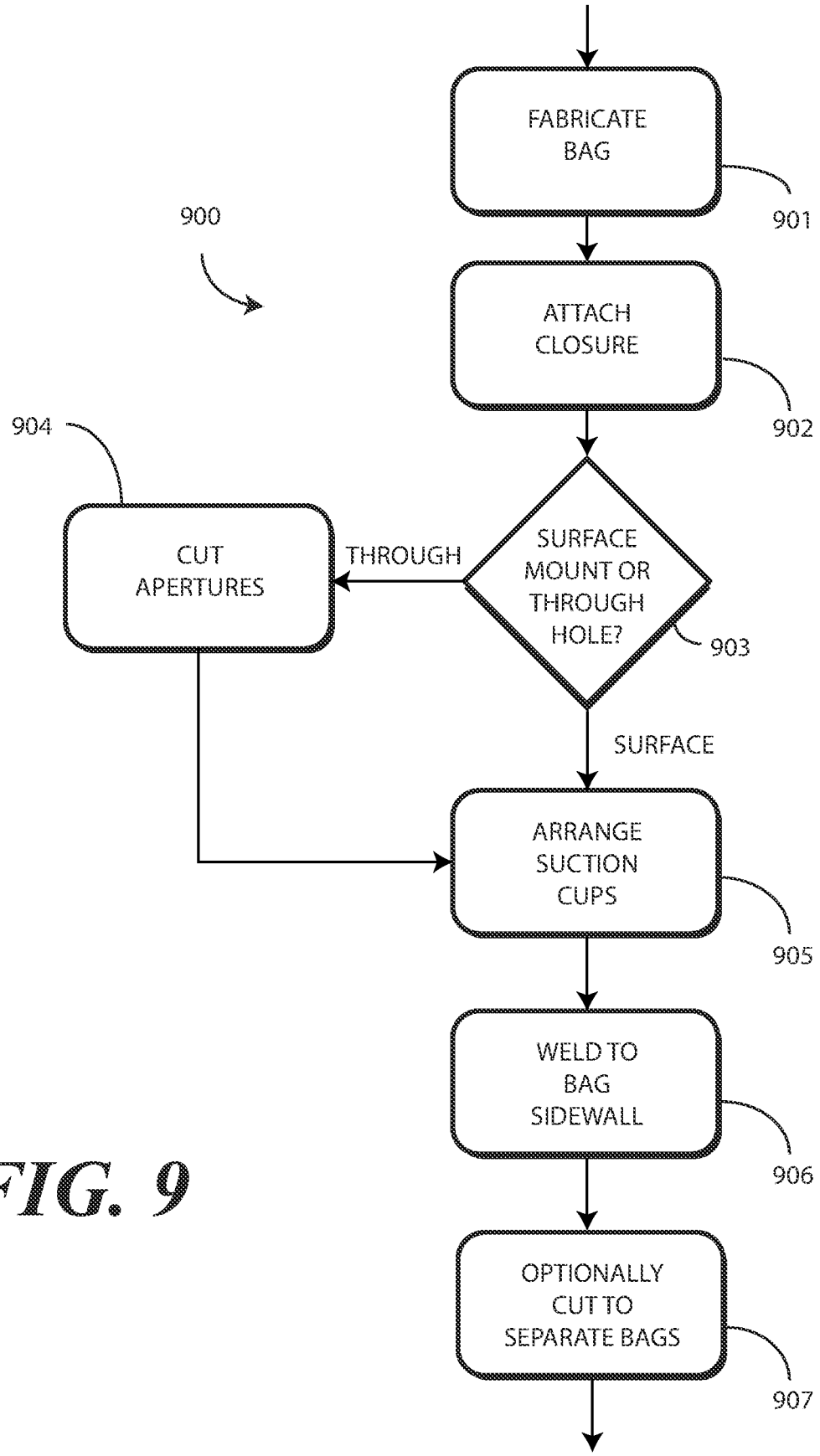
FIG. 9 illustrates one explanatory method in accordance with one or more embodiments of the disclosure.

Turning now to FIG. 9, illustrated therein is one explanatory method 900 for manufacturing a bag in accordance with one or more embodiments of the disclosure. Beginning at step 901, a bag is fabricated. In one or more embodiments, step 901 comprises delivering at least one elongated web of thermoplastic material, such as polyvinyl chloride, to a production device. While polyvinyl chloride is one example of a thermoplastic materials, any of the others mentioned above can be used as well.

The at least one elongated web of thermoplastic material can be a single web of thermoplastic material or two separate webs of thermoplastic material. Where the at least one elongated web of thermoplastic material is a single web of thermoplastic material, step 901 can comprise folding the single web of thermoplastic material so as to define a side edge (or bottom) of one or more bags. Thereafter, step 901 can comprise creating two additional side edges such that the one or more bags include three side edges and an opening. In one or more embodiments, step 901 comprises using a radio frequency welding process to create the two additional side edges. However, other attachment techniques mentioned above, including adhesive attachment, sonic welding, and thermal welding, can be used as well. Even more attachment techniques will be obvious to those of ordinary skill in the art having the benefit of this disclosure.

Where the at least one elongated web of thermoplastic material is two separate webs of thermoplastic material, step 901 can comprise creating three side edges such that the one or more bags include three side edges and an opening. In one or more embodiments, step 901 comprises using a radio frequency welding process to create the two additional side edges. However, other attachment techniques mentioned above, including adhesive attachment, sonic welding, and thermal welding, can be used as well.

At step 902, an enclosure is attached to the one or more bags. In one or more embodiments, the enclosure comprises a zipper lock having a first zipper lock portion attached to a first side of the bag at a location situated proximally with the opening and a second zipper lock portion attached to a second side of the bag at a location situated proximally with the opening. While zipper locks are one type of closure suitable for use at step 902, other types of closures could be used as well. Illustrating by example, press-fit adhesive closures, folding closures, clamps and/or clips, drawstrings, or other types of closures can be used as well.

Decision 903 determines whether through-hole suction cups, one example of which is shown above with reference to FIG. 5, or surface-mount suction cups, one example of which is shown above with reference to FIG. 4, will be attached to the one or more bags. Where through-hole suction cups are used, step 904 comprises cutting apertures in a major surface of each bag of the one or more bags so that flanges of the through-hole suction cups can be attached to one side of the major surface while the sidewalls of the through-hole suction cups can pass through the apertures into the cavity of each bag of the one or more bags. By contrast, where surface-mount suction cups are to be used, no apertures are required and the method 900 moves to step 905.

At step 905, the suction cups are arranged along the major surface of each bag of the one or more bags in a predefined arrangement that will satisfactorily retain the bags to a smooth, flat surface such as the interior walls of a cooler, the interior walls of a refrigerator, sidewalls of watercraft, or other similar surfaces. In one or more embodiments, the number of suction cups to be arranged includes between three and six suction cups, inclusive. In one embodiment, step 905 comprises arranging three suction cups as described above with reference to FIG. 6. In another embodiment, step 905 comprises arranging four suction cups as described above with reference to FIG. 7. In yet another embodiment, step 905 comprises arranging six suction cups as described above with reference to FIG. 8. Other arrangements will be obvious to those of ordinary skill in the art having the benefit of this disclosure.

At step 906, the suction cups arranged at step 905 are attached to the major surface of each bag. In one or more embodiments, this step 906 comprises radio frequency welding each suction cup to the major surface of each bag, although any of the other coupling techniques described above (adhesives, thermal welding, sonic welding et al.) can be used instead. Where through-hole suction cups are used, step 906 comprises welding a flange extending from a perimeter of a nappe of each suction cup to a major surface of each bag with the sidewalls of the through-hole suction cups passing through the apertures into the cavity of each. By contrast, where surface-mount suction cups are to be used, step 906 comprises welding a base member of each suction cup to an exterior surface defined by the major surface of each bag.

At step 907, an optional cutting operation can be used to separate the one or more bags from each other. In one embodiment, step 907 comprises cutting the bags so as to have the dimensions described above with reference to FIG. 6. In another embodiment, step 907 comprises cutting the bags so as to have the dimensions described above with reference to FIG. 7. In yet another embodiment, step 907 comprises cutting the bags so as to have the dimensions described above with reference to FIG. 8. Other dimensions for bags will be obvious to those of ordinary skill in the art having the benefit of this disclosure.

Accordingly, in the method 900 of FIG. 9, step 901 can comprise attaching a first thermoplastic panel provided by a first elongated web of thermoplastic material or a first portion of a folded elongated web of thermoplastic material to a second thermoplastic panel provided by a second elongated web of thermoplastic material or a second portion of a folded elongated web of thermoplastic material. Step 905 comprises arranging one or more suction cups, which can include between three and six suction cups, along an exterior of the first thermoplastic panel. When using any of the arrangements described above with reference to FIGS. 6-8, this step 905 can comprise arranging the suction cups such that at least two suction cups are closer to the opening than at least a third suction cup. Step 906 can then comprise bonding the suction cups to the exterior of the first thermoplastic panel. In one or more embodiments, step 906 comprises radio frequency welding the suction cups to the exterior of the first thermoplastic panel.

Where either the arrangement described above with reference to FIG. 7 or the arrangement described above with reference to FIG. 8 is used, step 905 can comprise arranging the suction cups such that a first suction cup and a second suction cup are situated closer together and closer to the opening than are a third suction cup and a fourth suction cup. If the arrangement of FIG. 8 is used, at least a fifth suction cup will be closer to the opening than the third suction cup or the fourth suction cup, but farther from the opening than the first suction cup and the second suction cup.

Figure 10:
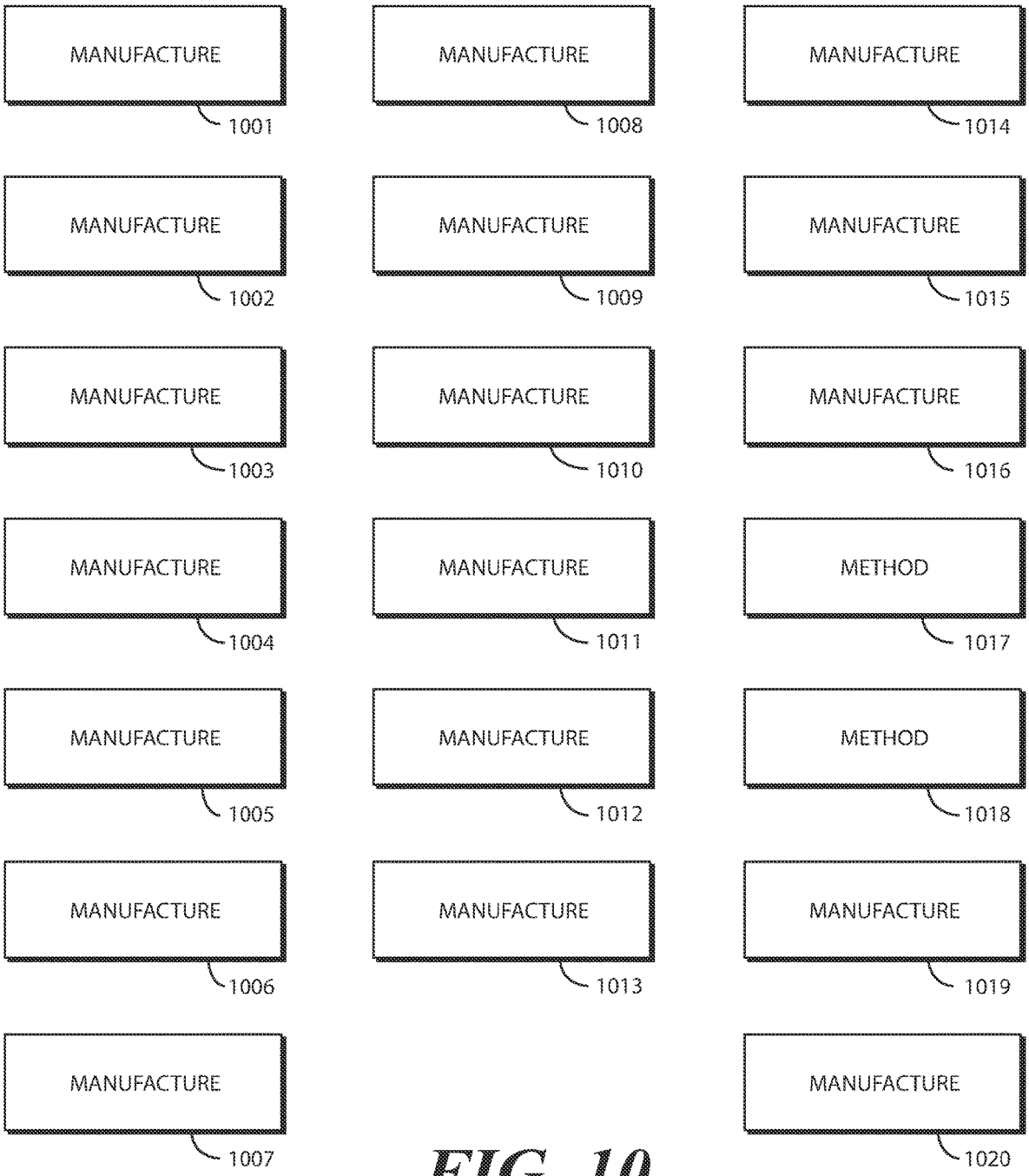
FIG. 10 illustrates various embodiments of the disclosure.

Turning now to FIG. 10, illustrated therein are various embodiments of the disclosure. The embodiments of FIG. 10 are shown as labeled boxes in FIG. 10 due to the fact that the individual components of these embodiments have been illustrated in detail in FIGS. 1-9, which precede FIG. 10. Accordingly, since these items have previously been illustrated and described, their repeated illustration is no longer essential for a proper understanding of these embodiments. Thus, the embodiments are shown as labeled boxes.

Beginning at 1001, a manufacture comprises a bag. At 1001, the manufacture comprises one or more suction cups attached to, or integrated into, a major surface of the bag.

At 1002, the bag of 1001 comprises a first thermoplastic panel defining the major surface and a second thermoplastic panel. At 1002, the second thermoplastic panel is joined to one or more side edges of the first thermoplastic panel. At 1002, the second thermoplastic panel defines another major surface of the bag. At 1002, the one or more suction cups are coupled only to the major surface of the bag with the other major surface being devoid of suction cups.

At 1003, the one or more suction cups of 1002 comprise between three and six suction cups.

At 1004, the first thermoplastic panel and the second thermoplastic panel of 1003 define an opening for the bag. At 1004, the bag further comprises a zipper lock having a first zipper lock portion attached to the first thermoplastic panel proximally with the opening and a second zipper lock portion attached to the second thermoplastic panel proximally with the opening. At 1004, the first zipper lock portion is selectively attachable to, and releasable from, the second zipper lock portion to selectively open, and close, the opening of the bag, respectively.

At 1005, the one or more suction cups of 1004 consist of three suction cups arranged along a suction cup arrangement axis oriented orthogonally with a major axis of the zipper lock. At 1006, the bag of 1005 has a major dimension of about six and a half inches and a minor dimension of about five inches.

At 1007, the one or more suction cups of 1004 consist of four suction cups. At 1007, a first suction cup and a second suction cup situated more proximally with the zipper lock are situated closer together than a third suction cup and a fourth suction cup situated more distally from the zipper lock. At 1008, the bag of 1007 defines a square having a major dimension of about ten inches.

At 1009, the one or more suction cups of 1004 consist of six suction cups. At 1009, a first suction cup is situated between a first edge of the bag and a second suction cup. At 1009, a third suction cup is situated between a second edge of the bag and the second suction cup. At 1009, a fourth suction cup is situated between the first edge of the bag and a fifth suction cup. At 1009, a sixth suction cup is situated between the second edge of the bag and the fifth suction cup.

At 1009, the first suction cup, the second suction cup, and the third suction cup are all situated more proximally with the zipper lock than the fourth suction cup, the fifth suction cup, and the sixth suction cup. At 1009, the first suction cup and the third suction cup are situated closer together than are the fourth suction cup and the sixth suction cup.

At 1009, the second suction cup and the fifth suction cup are arranged along a first suction cup arrangement axis oriented orthogonally with a major axis of the zipper lock. At 1009, the second suction cup is farther from the zipper lock than are the first suction cup and the third suction cup.

At 1010, the first suction cup and the second suction cup of 1009 are arranged along a second suction cup arrangement axis oriented parallel with the major axis of the zipper lock. At 1010, the fourth suction cup, the fifth suction cup, and the sixth suction cup are arranged along a third suction cup arrangement axis oriented parallel with the major axis of the zipper lock.

At 1011, the bag of 1010 defines a square having a major dimension of about twelve inches. At 1012, the second suction cup of 1010 is situated more than twice as far from the zipper lock than are the first suction cup and the third suction cup. At 1013, the one or more suction cups of 1004 are attached to the major surface of the first thermoplastic panel by radio frequency welding.

At 1014, each suction cup of the one or more suction cups of 1013 defines a base from which sidewalls of each suction cup extend distally. At 1014, the base is attached to the major surface of the first thermoplastic panel by the radio frequency welding.

At 1015, each suction cup of the one or more suction cups of 1013 comprises a flange extending distally from a perimeter of a nappe of each suction cup. At 1015, the major surface of the first thermoplastic panel defines one or more apertures. At 1015, the flange is attached to a first side of the major surface of the first thermoplastic panel. At 1015, the sidewalls of each suction cup extend distally through a corresponding aperture of the one or more apertures. At 1016, the major surface of the bag of 1001 defines the one or more suction cups.

At 1017, a method comprises attaching a first thermoplastic panel to a second thermoplastic panel to define a bag and an opening for the bag. At 1017, the method comprises arranging between three and six suction cups along an exterior of the first thermoplastic panel such that at least two suction cups are closer to the opening than at least a third suction cup. At 1017, the method comprises bonding the between three and six suction cups to the exterior of the first thermoplastic panel with a radio frequency weld.

At 1018, the between three and six suction cups of 1017 comprise at least four suction cups. At 1018, a first suction cup and a second suction cup are situated closer together and closer to the opening than are a third suction cup and a fourth suction cup.

At 1019, a manufacture comprises a first panel attached to a second panel, thereby defining a bag with an opening. At 1019, the manufacture comprises a closure attached to the opening and allowing the opening to be selectively closed.

At 1019, the manufacture comprises a plurality of suction cups attached to an exterior surface of the first panel. At 1019, all suction cups of the plurality of suction cups are arranged along a suction cup arrangement axis oriented orthogonally with a major axis of the closure.

At 1019, the plurality of suction cups comprises at least four suction cups with a first suction cup and a second suction cup situated closer together and closer to the opening than are a third suction cup and a fourth suction cup. At 1020, the plurality of suction cups of 1019 comprises a fifth suction cup situated farther from the opening that the first suction cup and the second suction cup and closer to the opening that the third suction cup and the fourth suction cup.

In the foregoing specification, specific embodiments of the present disclosure have been described. However, one of ordinary skill in the art appreciates that various modifications and changes can be made without departing from the scope of the present disclosure as set forth in the claims below. Thus, while preferred embodiments of the disclosure have been illustrated and described, it is clear that the disclosure is not so limited. Numerous modifications, changes, variations, substitutions, and equivalents will occur to those skilled in the art without departing from the spirit and scope of the present disclosure as defined by the following claims.

Accordingly, the specification and figures are to be regarded in an illustrative rather than a restrictive sense, and all such modifications are intended to be included within the scope of present disclosure. The benefits, advantages, solutions to problems, and any element(s) that may cause any benefit, advantage, or solution to occur or become more pronounced are not to be construed as a critical, required, or essential features or elements of any or all the claims.

What is claimed is:

1. A manufacture, comprising:

a bag; and one or more suction cups attached to, or integrated into, a major surface of the bag;

wherein each suction cup of the one or more suction cups defines a base fixedly attached to the major surface from which sidewalls of the each suction cup extend distally;

wherein:

the bag comprises a first thermoplastic panel defining the major surface and a second thermoplastic panel joined to one or more side edges of the first thermoplastic panel and defining another major surface of the bag, wherein the one or more suction cups are coupled only to the major surface of the bag with the another major surface devoid of suction cups;

the one or more suction cups comprise between three and six suction cups;

the first thermoplastic panel and the second thermoplastic panel define an opening for the bag, further comprising a zipper lock having a first zipper lock portion attached to the first thermoplastic panel proximally with the opening and a second zipper lock portion attached to the second thermoplastic panel proximally with the opening, wherein the first zipper lock portion is selectively attachable to, and releasable from, the second zipper lock portion to selectively open, and close, the opening of the bag, respectively; and the base of the each suction cup is wider than a diameter of substantially planar distal ends of the sidewalls situated at a nappe of the each suction cup and is attached to the major surface of the first thermoplastic panel by radio frequency welding.

2. The manufacture of claim 1, wherein the the one or more suction cups comprise three suction cups arranged along a suction cup arrangement axis.

3. The manufacture of claim 1, wherein the one or more suction cups comprise at least four suction cups.

4. The manufacture of claim 3, wherein the at least four suction cups comprise a first suction cup and a second suction cup situated closer together and closer to the opening than a third suction cup and a fourth suction cup.

5. The manufacture of claim 4, wherein the one or more suction cups consist of three suction cups arranged along a suction cup arrangement axis oriented orthogonally with a major axis of the zipper lock.

6. The manufacture of claim 5, wherein the bag has a major dimension of about six and a half inches and a minor dimension of about five inches.

7. The manufacture of claim 4, wherein the one or more suction cups consist of four suction cups with a first suction cup and a second suction cup situated more proximally with the zipper lock being situated closer together than a third suction cup and a fourth suction cup situated more distally from the zipper lock.

8. The manufacture of claim 7, wherein the bag defines a square having a major dimension of about ten inches.

9. The manufacture of claim 4, wherein the one or more suction cups consist of six suction cups with:

a first suction cup situated between a first edge of the bag and a second suction cup;

a third suction cup situated between a second edge of the bag and the second suction cup;

a fourth suction cup situated between the first edge of the bag and a fifth suction cup; and a sixth suction cup situated between the second edge of the bag and the fifth suction cup;

wherein:

the first suction cup, the second suction cup, and the third suction cup are all situated more proximally with the zipper lock than the fourth suction cup, the fifth suction cup, and the sixth suction cup;

the first suction cup and the third suction cup are situated closer together than are the fourth suction cup and the sixth suction cup;

the second suction cup and the fifth suction cup are arranged along a first suction cup arrangement axis oriented orthogonally with a major axis of the zipper lock; and the second suction cup is farther from the zipper lock than are the first suction cup and the third suction cup.

10. The manufacture of claim 9, wherein the first suction cup and the second suction cup are arranged along a second suction cup arrangement axis oriented parallel with the major axis of the zipper lock and the fourth suction cup, the fifth suction cup, and the sixth suction cup are arranged along a third suction cup arrangement axis oriented parallel with the major axis of the zipper lock.

11. The manufacture of claim 10, wherein the bag defines a square having a major dimension of about twelve inches.

12. The manufacture of claim 10, wherein the second suction cup is situated more than twice as far from the zipper lock than are the first suction cup and the third suction cup.

13. The manufacture of claim 1, wherein each suction cup is configured to attach to one or more of a lid of a cooler, a refrigerator sidewall, a boat sidewall, or a marine craft sidewall.

14. The manufacture of claim 1, wherein:

the base is planar;

an undersurface of the base is textured or patterned to make attachment of the base to the major surface of the first thermoplastic panel by the radio frequency welding more efficient;

the sidewalls are straight; and the sidewalls extend distally away from the base at an angle.

15. The manufacture of claim 1, wherein:

the base is planar; and the sidewalls are U-shaped.

16. The manufacture of claim 1, wherein the sidewalls extend distally from the base directly at an angle and the base and the sidewalls are manufactured as a singular, unitary component.

17. A manufacture, comprising:

a first panel attached to a second panel, thereby defining a bag with an opening;

a closure attached to the opening and allowing the opening to be selectively closed; and a plurality of suction cups attached to an exterior surface of the first panel, with each suction cup of the plurality of suction cups comprising a base that is wider than a maximum diameter of the each suction cup defined by straight sidewalls of the each suction cup that extend distally from the base;

wherein:

suction cups of the plurality of suction cups are arranged along one or more suction cup arrangement axes oriented parallel with a major axis of the closure; or the plurality of suction cups comprises at least four suction cups with a first suction cup and a second suction cup situated closer together and closer to the opening than are a third suction cup and a fourth suction cup.

18. The manufacture of claim 17, wherein the plurality of suction cups comprise a fifth suction cup situated farther from the opening that the first suction cup and the second suction cup and closer to the opening that the third suction cup and the fourth suction cup.

19. A manufacture, comprising:

a bag; and one or more suction cups attached to, or integrated into, a major surface of the bag;

wherein:

the bag comprises a first thermoplastic panel defining the major surface and a second thermoplastic panel joined to one or more side edges of the first thermoplastic panel and defining another major surface of the bag, wherein the one or more suction cups are coupled only to the major surface of the bag with the another major surface devoid of suction cups;

wherein the one or more suction cups comprise between three and six suction cups;

the first thermoplastic panel and the second thermoplastic panel define an opening for the bag, further comprising a zipper lock having a first zipper lock portion attached to the first thermoplastic panel proximally with the opening and a second zipper lock portion attached to the second thermoplastic panel proximally with the opening, wherein the first zipper lock portion is selectively attachable to, and releasable from, the second zipper lock portion to selectively open, and close, the opening of the bag, respectively;

wherein the one or more suction cups are attached to the major surface of the first thermoplastic panel by radio frequency welding; and each suction cup of the one or more suction cups comprises a flange extending distally from a perimeter of a nappe of the each suction cup;

the major surface of the first thermoplastic panel defines one or more apertures;

the flange is attached to a first side of the major surface of the first thermoplastic panel; and sidewalls of the each suction cup extend distally through a corresponding aperture of the one or more apertures.

20. The manufacture of claim 19, wherein the bag is rectangular.

* * * * *